US005887502A

United States Patent [19]

Yamaguchi et al.

[11] Patent Number: 5,887,502

[45] Date of Patent: Mar. 30, 1999

[54] ROTARY PUNCHING DEVICE

[75] Inventors: Shigenori Yamaguchi; Takuya Sato; Kazuyo Shudo; Kazuaki Baba, all of Tokyo, Japan

[73] Assignee: Max Co., Ltd., Tokyo, Japan

[21] Appl. No.: 720,259

[22] Filed: Sep. 26, 1996

[51] Int. Cl.[6] ..... B26D 1/56; B26F 1/10

[52] U.S. Cl. ..... 83/76; 83/164; 83/295; 83/311; 83/324; 83/345; 83/364; 83/670

[58] Field of Search ..... 83/164, 295, 311, 83/345, 364, 669, 670, 690, 324, 684, 685, 686, 76

[56] References Cited

U.S. PATENT DOCUMENTS

| | | | |
|---|---|---|---|
| 1,993,041 | 3/1935 | Singer | 83/164 |
| 2,604,167 | 7/1952 | Oliver | 83/690 X |
| 3,106,859 | 10/1963 | Huffman | 83/345 |
| 4,083,273 | 4/1978 | Hillman et al. | 83/660 X |
| 4,090,118 | 5/1978 | Smith, Jr. | 83/295 X |
| 4,183,271 | 1/1980 | Martin | 83/295 X |
| 4,273,015 | 6/1981 | Johnson | 83/345 X |
| 4,294,146 | 10/1981 | Ohtake | 83/311 X |
| 4,453,436 | 6/1984 | Tokuno | 83/324 X |
| 4,594,923 | 6/1986 | Fujita | 83/364 X |
| 4,667,551 | 5/1987 | Kuromaru et al. | 83/295 X |
| 4,805,501 | 2/1989 | Nuttin | 83/345 X |

FOREIGN PATENT DOCUMENTS

| | | |
|---|---|---|
| 900885 | 2/1985 | Belgium . |
| 207 442 | 1/1987 | European Pat. Off. . |
| 0 494 087 | 7/1992 | European Pat. Off. . |
| 0 519 525 | 12/1992 | European Pat. Off. . |
| 1 218 685 | 5/1960 | France . |
| 1 589 211 | 4/1970 | France . |
| 357482 | 8/1922 | Germany . |
| 31 34789 | 5/1982 | Germany . |
| 34 19 254 | 10/1985 | Germany . |
| 92 11 522 | 10/1992 | Germany . |
| 8400059 | 8/1985 | Netherlands . |
| WO 92/05959 | 4/1992 | WIPO . |

OTHER PUBLICATIONS

Patent Abstracts of Japan, JP 06 182697, vol. 18, No. 524, 4 Oct. 1994.

Patent Abstracts of Japan, JP 07 136995, vol. 95, No. 8, 29 Sep. 1995.

Patent Abstracts of Japan, JP 07 040293, vol. 95, No. 5, 30 Jun. 1995.

*Primary Examiner*—Eugenia A. Jones

*Attorney, Agent, or Firm*—Morgan, Lewis & Bockius LLP

[57] ABSTRACT

A rotary punching device for punching a hole on a sheet includes: a first rotary shaft having an outer peripheral surface; a punch mounted on the outer peripheral surface of the first rotary shaft; a second rotary shaft arranged in parallel with the first rotary shaft, the second rotary shaft having an outer peripheral surface; a die mounted on the outer peripheral surface of second rotary shaft; a motor connected to the first and second rotary shafts to synchronously drive the first and second rotary shafts such that the punch and the die are engaged with each other within a predetermined rotational angle range; a sheet feeding mechanism for feeding the sheet into between the first and second rotary shafts at a constant sheet feeding speed to punch the sheet by the punch and the die; and controller for controlling the rotation speed of the motor referring to the sheet feeding speed.

6 Claims, 17 Drawing Sheets

ROTARY PUNCHING DEVICE

BACKGROUND OF THE INVENTION

The present invention relates to a rotary punching device, and more particularly to a rotary punching device with improved punching quality.

Conventional rotary punching device which is incorporated in a copy machine and others to punch a circular hole at the edge of a copy sheet is well known. As shown in FIG. 7, in such a rotary punching device, a punch holder 3 with a mounted punch 2 is mounted on one rotary shaft 1 of two rotary shafts provided in parallel whereas a die holder 6 with a dice 5 is mounted on the other rotary shaft 4. A release hole 4*a* of the die 5 and a paper discharging hole 6*a* of the die holder 6 and the hole 3*a* of the rotary shaft 4 are aligned in a straight line.

Gear wheels (not shown) are engaged in the two rotary shafts 1 and 4, respectively so as to be meshed with each other. When either one of rotary shafts is driven by a motor, punch 2 and die 5 are synchronously rotated at a constant speed. Thus, the punch 2 and the die 5 repeat engagement and disengagement.

As shown in FIG. 24(*a*), the tip surface of the cylindrical punch 2 is formed in a flat shape. As shown in FIG. 7, the punch 2 is inserted into a punch attachment hole of the punch holder 3 engaged on the rotary shaft 1 and secured there by a fastening screw (not shown). The die 5 is inserted into a die attachment hold of a die holder 6 engaged on the rotary shaft 4 and secured there by a fastening screw (not shown).

The rotary punching device is configured so that the sheet feeding speed of a sheet feeding mechanism for feeding a sheet P between the two rotary shafts 1 and 4 is equal to the circumferential speed of the punch 2 and die 5. Thus, the punch 2 and dice 5 rotate in synchronism with the fed sheet to punch a hole in the sheet P. The punched sheet piece is externally discharged from the release hole 4*a* of the die 5 through the hole 3*a* of the rotary shaft 4 and the sheet-piece discharging hole 6*a* of the die holder 6.

Assuming that the circumferential speed of the tip of the punch 2 and die 5 is $V_1$, the linear speed $V_{1x}$ of the punch 2 and die 5 in a sheet feeding direction is $V_{1x}=-V_1 \cos \theta$ which varies at a period of 360°. As shown in FIG. 22, when the circumferential speed $V_1$ of the punch 2 and die 5 is set to be equal to a sheet feeding speed $V_2$, the linear speed $V_{1x}$ of the punch 2 and die 5 coincides with the feeding speed $V_2$ of the sheet P only at the rotation angle of 180° of the punch 2. Before and after the angle of 180°, the linear speed $V_{1x}$ of the punch 2 and die 5 is lowered with respect to the feeding speed $V_2$.

For this reason, because of changes in the linear speed $V_{1x}$ of the punch 2 and the die 5 in an engagement range (150°–210°) between the punch 2 and die 5, various inconveniences such as deformation of the punching hole and rupture of the edge thereof will occur.

In order to prevent rupture of the punching hole, a rotary punching device has been proposed in which the circumferential speed $V_1$ of the punch 2 and die 5 is set to be slightly higher than the sheet feeding speed $V_2$ so that as shown in FIG. 23, $V_{1x}=V_2$ at an engagement starting point (150°) and an engagement ending point (210°). In this case, however, $V_{1x}>V_2$ between the above two points and hence the longitudinal form of the punching hole is a short ellipse.

The conventional rotary punching device has problems such as breakage and deformation of the punching hole due to a change in the relative speed between the punch and die driven at a constant rotation speed and a sheet fed at a constant linear speed. This gives rise to a technical problem to be solved in order to improve the quality of the punch hole.

In the rotary punching device, if a sheet-piece is discharged at a waiting position where the die stops rotation, it will be discharged at substantially the same position. But the sheet piece does not necessarily always drop at the same time due to various causes, such as accumulation of sheet pieces in the release hole of the die and influence by static electricity, and is frequently discharged during the rotation of the die. Thus, a large amount of sheet pieces will be dispersed.

This gives rise to a technical problem of controlling the discharging direction of punched sheet pieces so as to be always constant, thereby making cleaning easy.

FIG. 25 is a graph showing the punching load of the above rotary punching device. As seen from the figure, it exhibits a concave-shape load curve with peaks at the starting and ending points of cutting and particularly the maximum peak at the ending point.

This is because, as shown in FIG. 26, the cutting length of the punching hole per a unit of rotating angle θ increases in the second half of a cutting stroke to reach the maximum at the end point of cutting. For this reason, the driving motor for the punch and die requires large torque, and the rotary shafts 1 and 4 require high warping rigidity, thus hindering the miniaturization of the driving mechanism.

This gives rise to a technical problem of reducing the peak of the punching torque to relax the load of the device.

Furthermore, the sheet feeding device may provide a variation in the sheet feeding speed because of changes in the diameter due to abrasion of a sheet feeding roller and in the friction coefficient on the surface of the roller. In this case, a difference occurs between the sheet feeding speed and the linear speed of the punch and die, thus leading to poor punching. For example, the shape of the punching hole may be deformed and the edge of the punching hole may be broken. Further, the linear speed of the punch arranged upstream may exceed the sheet feeding speed of the sheet feeding downstream on a sheet feeding path so that the intermediate portion of the sheet floats from the sheet guide. The sheet may flutter to produce abnormal sound.

This gives rise to a technical problem of preventing the variance between the sheet feeding speed and the linear speed of a punch and a die from being generated, thereby stabilizing punching quality. The present invention intends to solve the above problem.

SUMMARY OF THE INVENTION

According to a first aspect of the invention, there is provided a rotary punching device for punching a hole on a sheet comprising: a first rotary shaft having an outer peripheral surface; a punch mounted on the outer peripheral surface of the first rotary shaft; a second rotary shaft arranged in parallel with the first rotary shaft, the second rotary shaft having an outer peripheral surface; a die mounted on the outer peripheral surface of second rotary shaft; a motor connected to the first and second rotary shafts to synchronously drive the first and second rotary shafts such that the punch and the die are engaged with each other within a predetermined rotational angle range; a sheet feeding mechanism for feeding the sheet between the first and second rotary shafts at a constant sheet feeding speed to punch the sheet by the punch and the die; a controller for controlling the rotational speed of the motor corresponding to the sheet feeding speed.

According to a second aspect of the invention, there is provided the rotary punching device according to the first aspect, wherein the controller controls the motor such that the linear speed of the punch and die in a sheet feeding direction is within an engagement range between the punch and the die coincides with the feeding speed of the sheet.

According to a third aspect of the invention, there is provided the rotary punching device according to the first aspect, further comprising: a die holder attached to the second rotary shaft, having a die attaching hole into which the die is inserted; a sheet piece guide extending from the die holder in a direction of rotation of the second rotary shaft to form a sheet-piece discharging path progressing from an end of a transverse hole formed through the second rotary shaft to an exit opening laterally removed from the end of the transverse hole.

According to a fourth aspect of the invention, there is provided the rotary punching device according to the first aspect, wherein the punch has a cutting end which defines a forward, upwardly sloped planar surface, an intermediate planar surface, and a rearward downwardly sloped planar surface.

According to a fifth aspect of the invention, there is provided the rotary punching device according to the first aspect, wherein the controller comprises: a pair of sheet detection sensors arranged along a feed direction of the sheet; a computing unit for computing the sheet feeding speed on the basis of the distance between the pair of sheet detection sensors and a time difference of sheet detection between both sensors; and a feed-back controller means for feed-back controlling the motor in accordance with a difference between the computed sheet feeding speed and the linear speed of the punch and die to coincide the sheet feeding speed with the linear speed of the punch and die.

DETAILED DESCRIPTION OF THE PREFERRED EMBODIMENT

Figure 1:
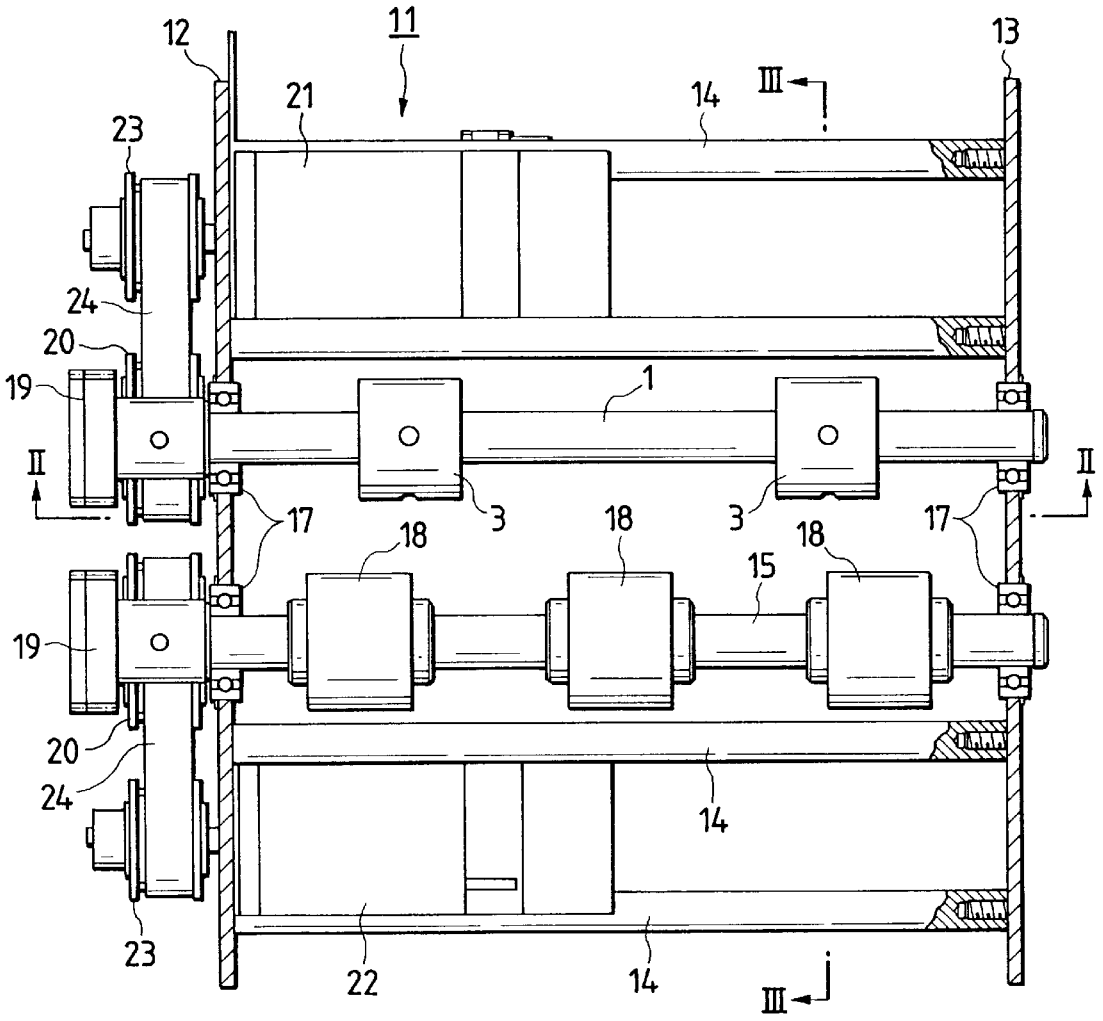
FIG. 1 is a partially broken plan view of a rotary punching device according to one embodiment of the invention.
Figure 2:
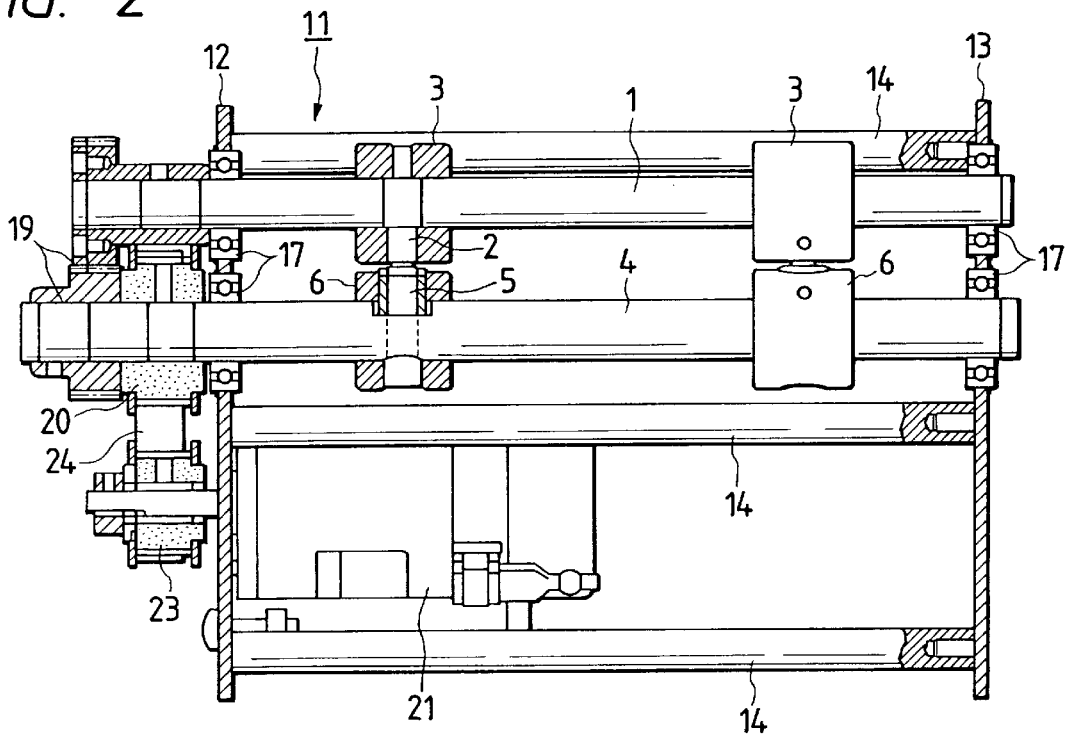
FIG. 2 is a view in the direction of arrow of II—II in FIG. 1.
Figure 3:
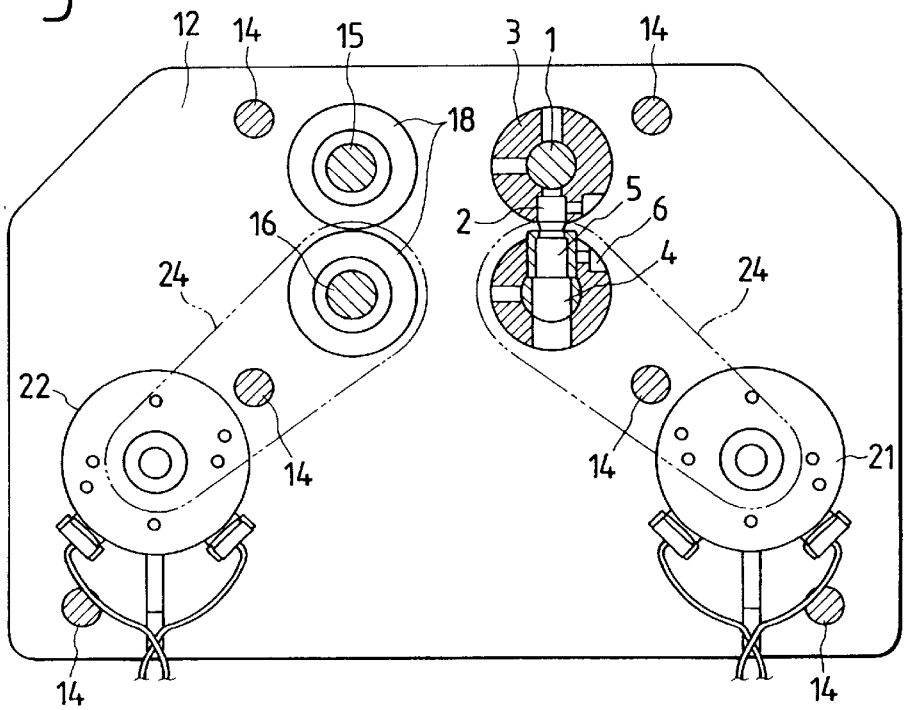
FIG. 3 is a view in the direction of arrow of III—III in FIG. 1.

Now, referring to FIGS. 1 to 6, a detailed explanation will be given of an embodiment of the present invention. FIGS. 1 to 3 show a rotary punching device 11. As seen from FIGS. 1 and 2, right and left side plates 12, 13 are coupled by transverse members 14 to constitute a frame, and two (front and rear) couples of upper and lower rotary shafts 1, 4; 15, 16, as shown in FIG. 3, are axially mounted to right and left side plates 12 and 13 by ball bearings 17.

To the upper rotary shaft 1 on the right side of FIG. 3, right and left cylindrical punch holders 3 are attached as shown in FIG. 2, whereas to the lower rotary shaft 4 on the right side, die holders 6 are attached to positions corresponding to the punch holders 3. A punch 2 and a die are 5 are inserted into the holes on the outer peripheral surfaces of the punch holder 3 and the die holder 6, respectively. The punch 2 and die 5 are secured to the rotary shafts by fastening screws (not shown). Into the upper and lower rotary shafts 15 and 16 on the rear side, pinch rollers 18 are engaged at the right, intermediate and left positions, respectively so that the upper and lower pinch rollers 18 are in contact with each other.

As shown in FIG. 2, flat gear wheels 19 are engaged at one end of the rotary shafts 1, 4; 15, 16 so that the upper and lower flat gear wheels 19 are meshed with each other. Toothed pulleys 20 are engaged to the lower rotary shafts 4 and 16 on the front and rear sides in parallel to the flat gear wheels 19. Timing belts 24 couple the toothed pulley 23 of a stepping motor 21 at the front side of the frame and the toothed pulley 20 of the lower rotary shaft 4, and couple the toothed pulley 23 of another stepping motor 22 on the rear side of the frame and the toothed pulley 20 of the lower rotary shaft 16.

In FIG. 3, when the stepping motors 21 and 22 are rotated counterclockwise, the upper rotary shafts 1 and 15 rotate synchronously with the associated lower rotary shafts 4 and 16, and a sheet (not shown) inserted from the right between the upper and lower rotary shafts is caught by the pinch rollers 18, fed leftward, and punched by the punch and die 5 which are engaged with each other once for each rotation.

Figure 4:
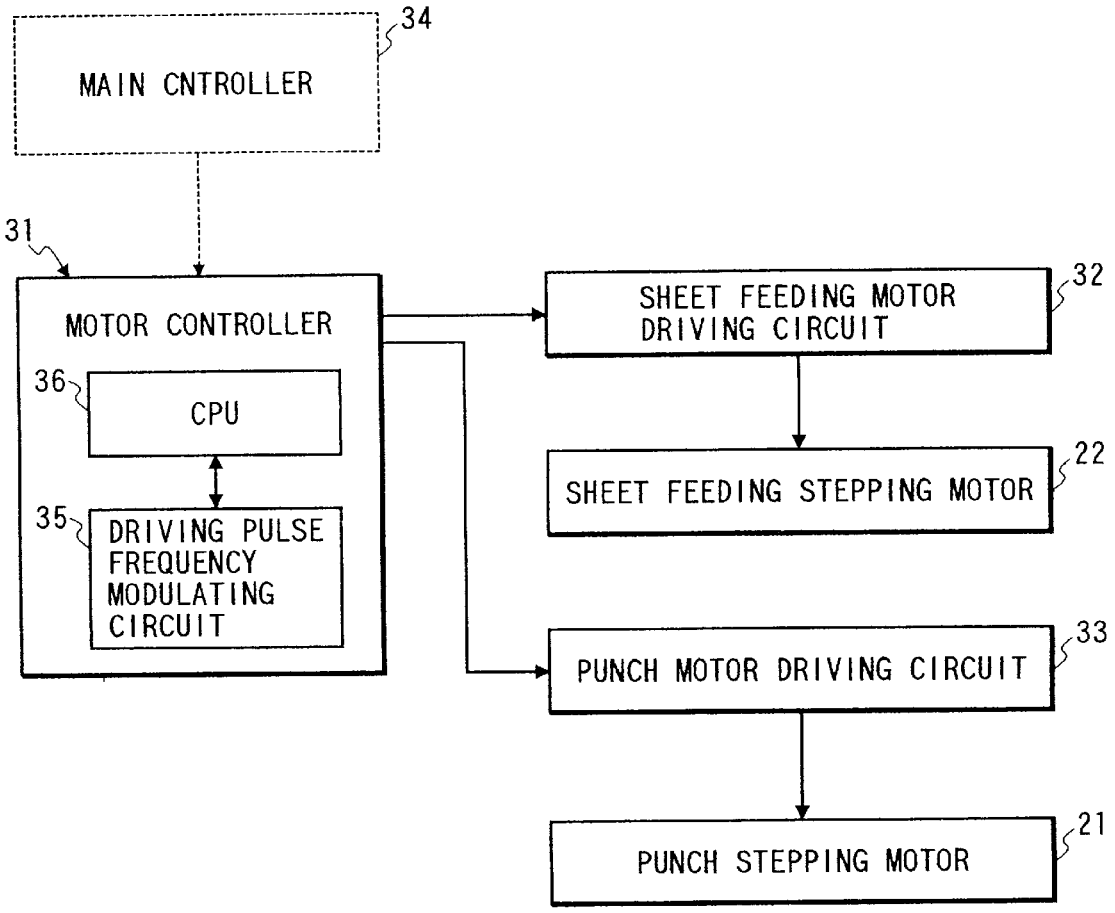
FIG. 4 is a circuit block diagram of the rotary punching device according to the present invention.

FIG. 4 is a circuit block diagram of the rotary punching device 11. A motor controller 31 controls a sheet-feeding-motor driving circuit 32 and a punch motor driving circuit 33 so that a sheet feeding stepping motor 22 and a punching stepping motor 21 are driven. In accordance with a command from a main controller 34 such as a controller for a copy machine in which the rotary punching device 11 is installed, the motor controller 31 drives the sheet feeding motor driving circuit 32 and the punch motor driving circuit 33 to produce motor driving pulses.

A driving pulse frequency modulating circuit 35, which is included in the motor controller 31, frequency-modulates pulses to be supplied to the punch motor driving circuit 33 under the control of CPU 36 to control the rotary speed of the punching stepping motor 21.

Figure 5:
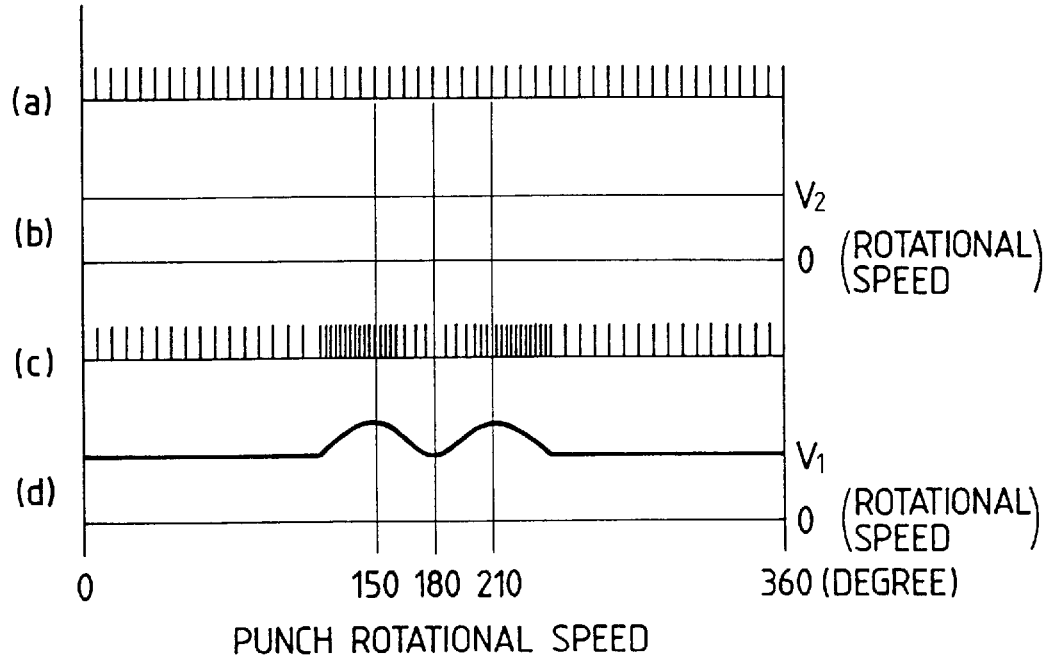
FIG. 5 is a timing chart of output pulses of a motor control device and a punch rotating speed according to the invention.

FIG. 5 is a timing chart of output pulses of the motor controller 31. As seen from the chart, pulses (a) for sheet feeding motor driving pulses are generated at a fixed frequency, the stepping motor 22 for sheet feed is rotated at a fixed rotation speed and the sheet is fed thereby at a fixed speed $V_2$ indicated by (b).

Punch motor driving pulses (c), under the control by the CPU 36 and the driving pulse frequency modulation circuit 35, control the punch 2 and die 5 to obtain $V_1=-V_2/\cos\theta$ within a range of an engagement starting point of 150° to an engagement ending point of 210°, and as indicated by (d), the punch 2 and die 5 rotate in such a pattern that their circumferential speed $V_1$ is decelerated within a range of 150° to 180° and accelerated within a range of 180° to 210°.

Figure 6:
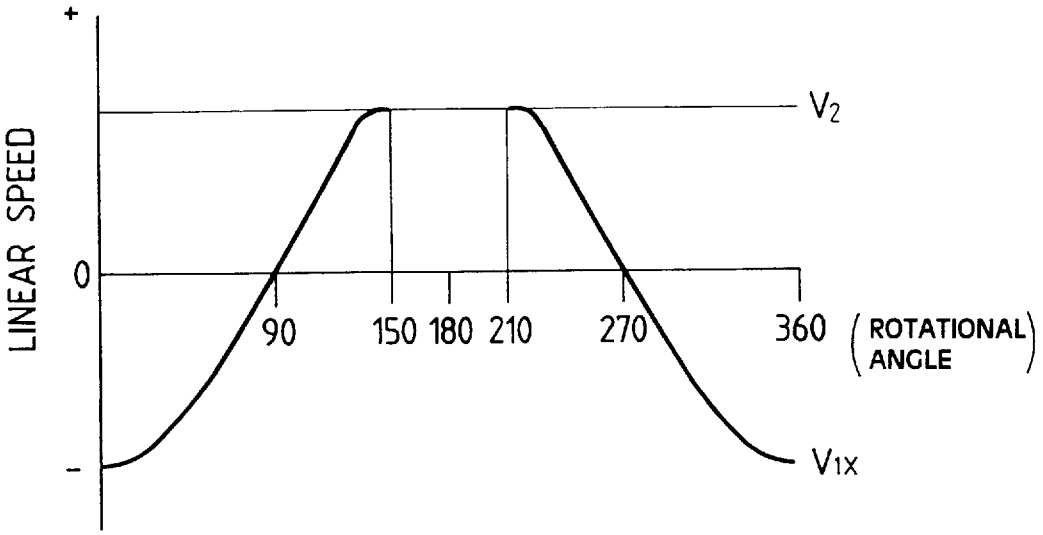
FIG. 6 is a graph showing the sheet feeding speed and the linear speed of the rotary punching device according to the present invention.

Thus, the linear speed $V_{1x}$ of the punch 2 and die 5 is $V_{1x}=-(-V_2/\cos\theta)\cos\theta=V_2$ in the above rotation range. As shown in FIG. 6, the linear speed $V_{1x}$ of the punch 2 and die 5 on the sheet feeding path coincides with the feed speed $V_2$ of the sheet within the above rotation range (150°–210°).

The pitch when the punching hole is successively punched can be changed by varying the speed of the disengagement range (0°–150° and 210°–360°) of one cycle indicated by (c) and (d) of FIG. 5.

The embodiment of the present invention should not be limited to the above embodiment. Various modifications can be made in a technical scope of the present invention. For example, a servo motor may be used in place of the stepping motor. It is needless to say that the present invention covers these modifications.

Figure 8:
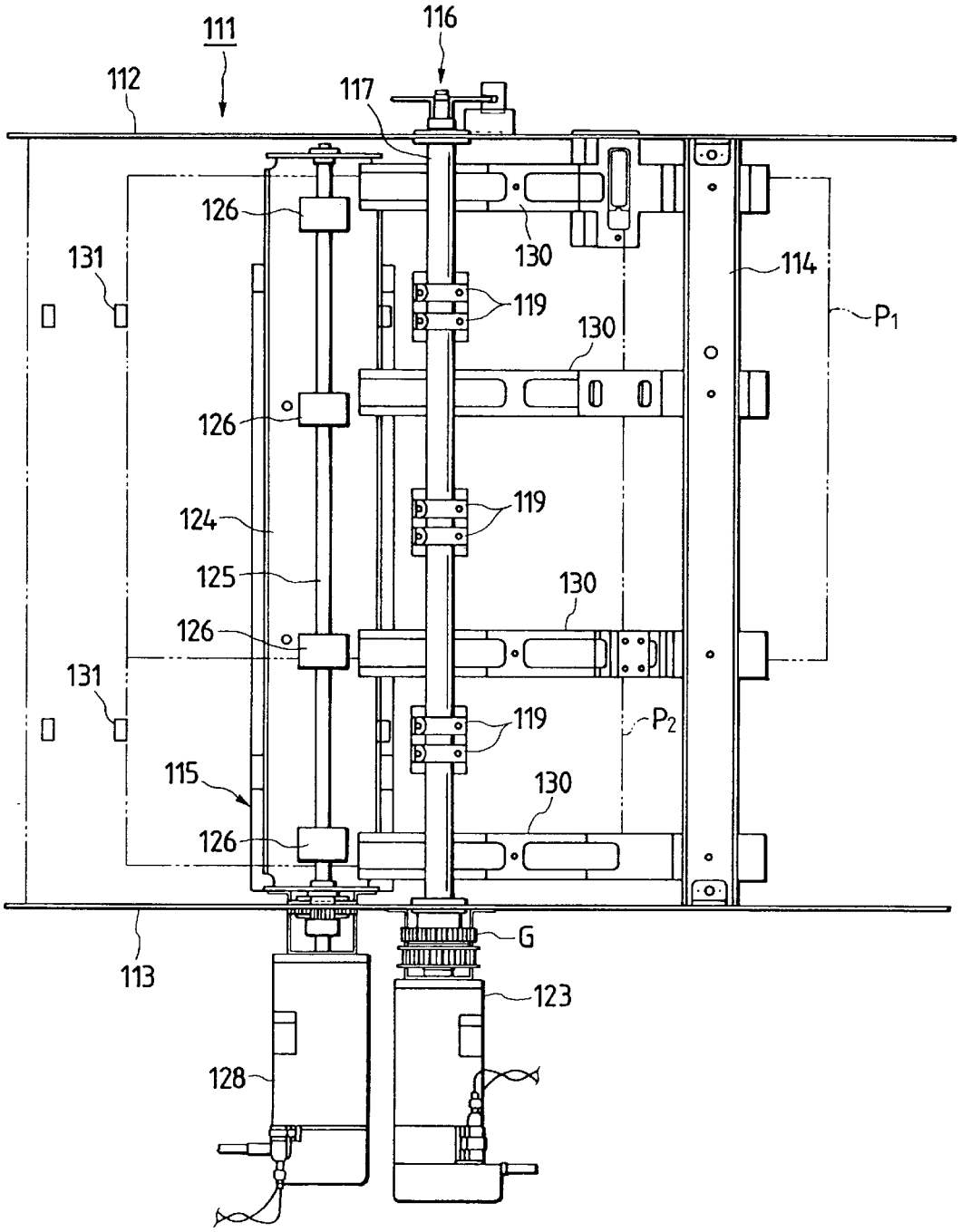
FIG. 8 is a plan view of a rotary punching device according to another embodiment of the invention.
Figure 9:
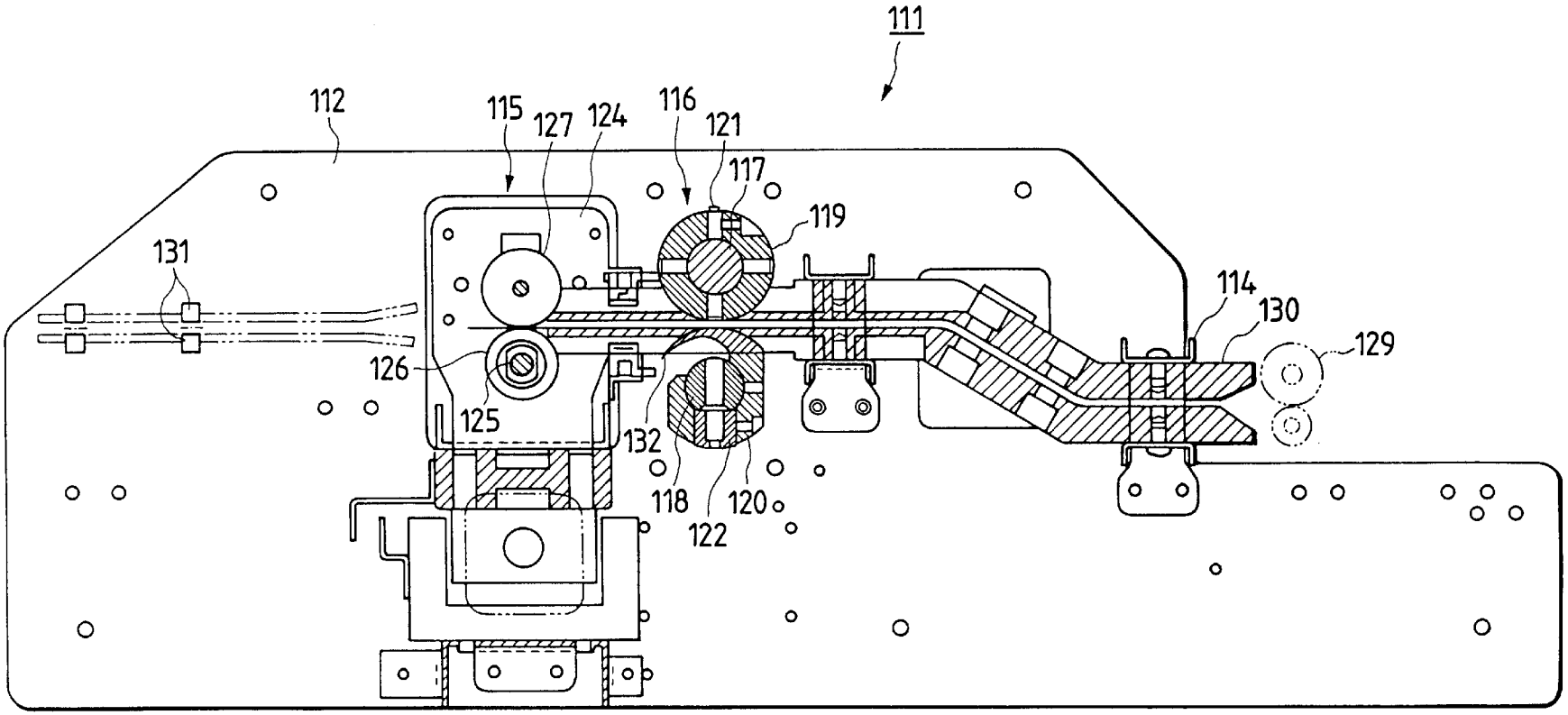
FIG. 9 is a side view of the rotary punching device of FIG. 8.

Now, referring to FIGS. 8 to 11(*c*), a detailed explanation will be given of another embodiment of the present invention. FIGS. 8 and 9 show a rotary punching device 111 which is incorporated in a copy machine. As seen from FIGS. 8 and 9, a pair of side plates 112 and 113 are coupled by transverse members 114 to constitute a frame. Between the side plates 112 and 113, a sheet feeding unit 115 and rotary punching portion 116 (hereinafter referred to as simply "punching portion") are arranged in parallel.

At the punching portion 116, an upper punch rotary shaft 117 and a lower die rotary shaft 118 are arranged in parallel. Punch holders 119 are attached to the center of the punch rotary shaft 117 and the right and left thereof, respectively. Die holders 120 are attached to the die rotary shaft 118 at the positions corresponding to the upper punch holders 119. The punch 121 and the die 122 are inserted into the respective punch attachment hole and die attachment hole made on the outer peripheral surface of the punch holder 119 and die holder 120, respectively and fastened to the rotary shafts 117 and 118 by a fastening screw (not shown).

At one end of the punch rotary shaft 117 and the die rotary shaft 118, flat gear wheels G are fit so as to be meshed with each other. Each rotary shaft and a servo motor 123 or stepping motor are coupled with each other by a timing belt so that the punch rotary shaft 117 and the die rotary shaft 118 are synchronously rotated.

In the sheet feeding unit 115, sheet feeding rollers 126 are engaged on a rotary shaft 125 hung on a unit frame 124 at regular intervals, and as shown in FIG. 9, pinch rollers 127 are arranged at the upper position of the rotary shaft 125 and brought into contact with the sheet feeding rollers 126. Similar to the hole punching portion 116, the rotary shaft 125 is driven by a servo motor 128. Thus, the sheet feeding rollers 126 and the pinch rollers 127 catch the sheet P and feed it from right to left in FIG. 9.

The sheet introduced into a sheet guide 130 of the rotary punching device 111 through sheet discharging rollers 129 of a copy machine indicated by dotted line in FIG. 9 passes between the punch holders 119 and die holders 120 and is pulled between the rollers 126 and 127 and fed forward. The control section starts to measure the amount of sheet feeding of the sheet feeding unit 115 when the sheet reaches the positions of photointerrupters 131 arranged forward of the sheet feeding unit 115 and starts to operate the hole punching portion 116 when a predetermined amount of sheet feeding to punch the sheet at a prescribed position in the vicinity of its rear edge.

Figure 10:
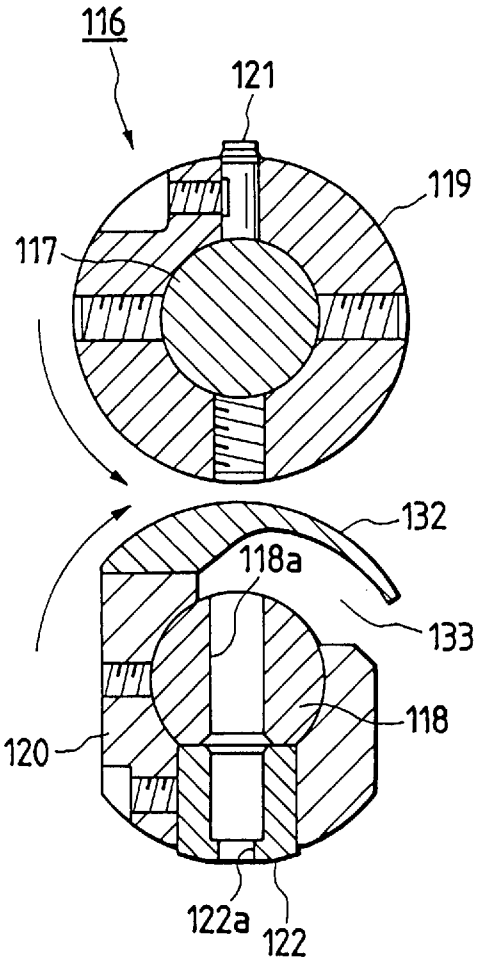
FIG. 10 is a side view of a hole punching portion of the rotary punching device of FIGS. 8 and 9.
Figure 7:
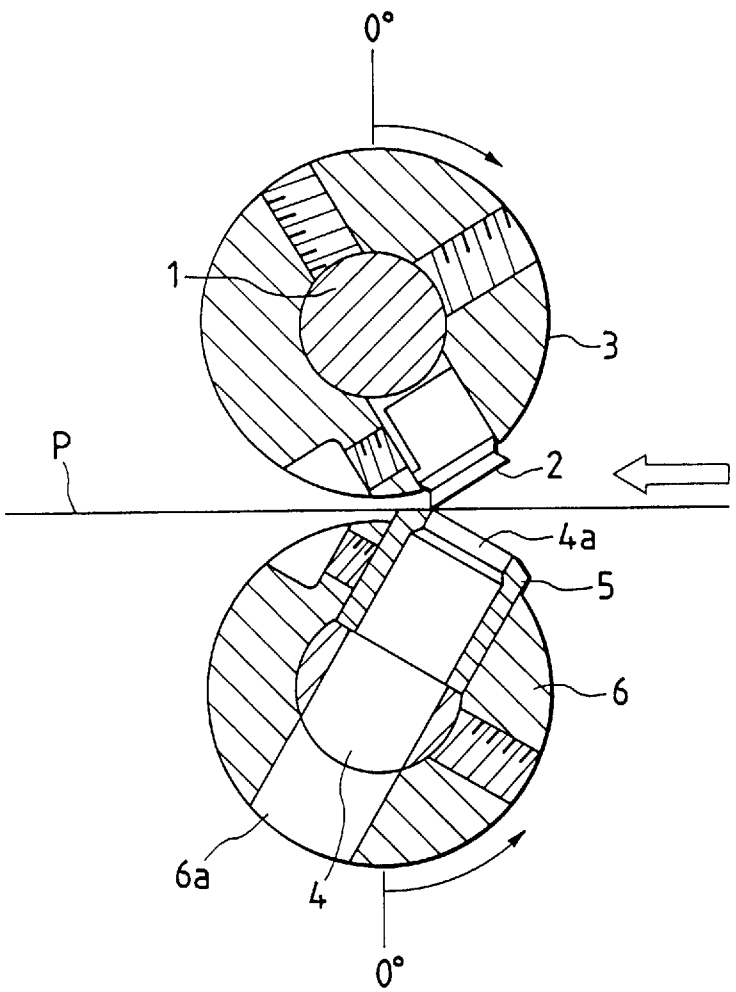
FIG. 7 PRIOR ART
FIG. 7 is a sectional view showing a conventional prior art punch and die.

FIG. 10 shows the hole punching portion 116. In FIG. 10, the sheet of paper is fed from left to right. The punch 121 rotates counterclockwise whereas the die 122 rotates clockwise. At the center of the die holder 120, a hole is made which receives the die rotary shaft 118. A die receiving attachment hole extends to the center hole from the outer peripheral surface of the die holder 120. The outer peripheral surface of the die holder attachment portion of the die rotary shaft 118 is shaped in a D-shape, and a hole 118*a* penetrates through the axial center of the first portion of the D-shape.

The die rotary shaft 118 is inserted into the center hole of the die holder 120 and the die 122 is inserted into the die attachment hole of the die holder 120 so that the bottom of the die 122 abuts on the flat portion of the die rotary shaft 118. Thus, the release hole 122*a* of the die 122 is linearly aligned with the hole 118*a* of the die rotary shaft 118. The die holder 120 and the die 122 are screw-fastened in this position.

On the opposite side of the die attachment hole of the die holder 120, a portion of the die holder opposite the die attachment hole and extending in the rotating direction is removed to expose a portion of the outer peripheral surface of the die rotary shaft 118. An arc-shaped guide 132 is mounted at the rear side of the rotating direction from the extending direction of the die attachment hole. The arc shaped guide 32 extends in an arc shape forward in the rotating direction around the axial center of the die rotating shaft 118. Thus, a sheet piece discharging hole 133 is formed which is swept forward in the rotating direction from the hole 118*a* of the die rotating shaft 118.

Figure 11A:
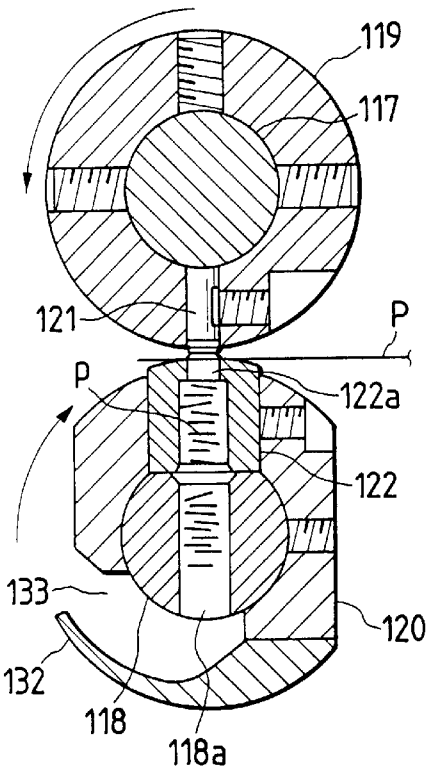
FIGS. 11(*a*), 11(*b*) and 11(*c*) are views explaining the strokes of the hole punching portion.
Figure 11B:
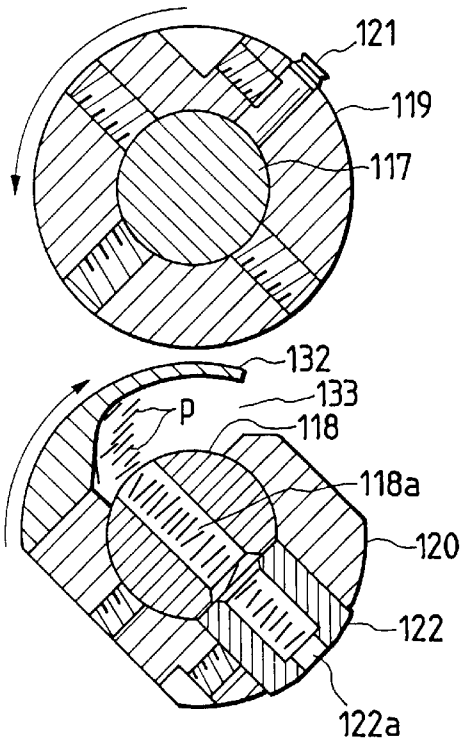
Figure 11C:
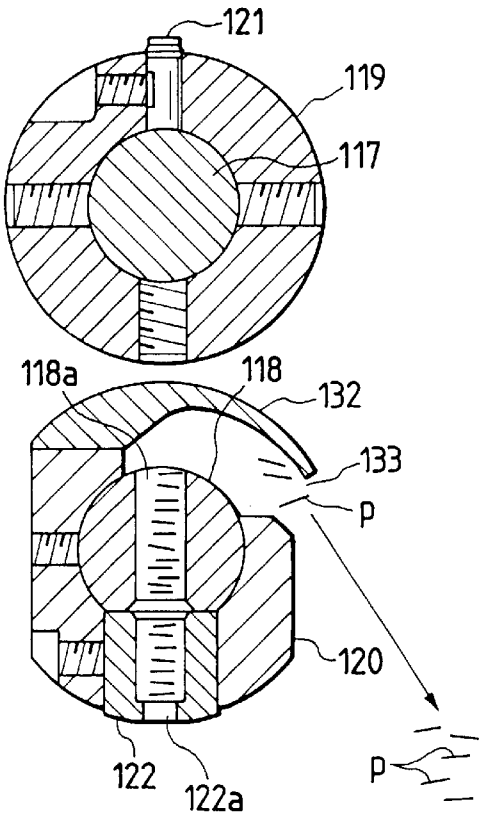

The punch 121 rotates counterclockwise from the initial position shown in FIG. 10, wherein the die 122 rotates clockwise in synchronism with the punch 121. Thus, as shown in FIG. 11(*a*), the punch 121 and die 122 engage with each other to punch the sheet P. The punched sheet piece p is pushed into the release hole 122*a* of the die 122. But, because of the centrifugal force when the die holder 120 is rotated, the sheet piece remains in the release hole 122*a*. When the punching is repeated, sheet pieces will accumulate from the release hole 122*a* to the hole 118*a* of the die rotary shaft 118.

When the hole 118*a* is filled with sheet pieces p as a result of continued accumulation of the sheet pieces, as shown in FIG. 11(*b*), the leading sheet piece p hits the inner peripheral slope of the arc shaped guide 132 because of the centrifugal force when the die holder 120 rotates and changes direction its along the slope.

As shown in FIG. 11(*c*), when the die holder 120 returns to the initial position to stop rotation, the sheet pieces p on the arc shaped guide 132 move toward the tangential direction of rotational movement because of rotation inertia and are discharged from the opening of the sheet discharging hole 133.

Accordingly, the punched sheet pieces p are held by the arc shaped guide 132 while the die holder 120 rotates and are discharged in a single direction when the die holder stops. For this reason, the sheet pieces p are not scattered. A saucer placed at a prescribed position can prevent the sheet pieces from being scattered and the sheet pieces can be easily captured and removed.

The present invention should not be limited to the above embodiment. Various modifications can be made in a technical scope of the present invention. For example, the die holder 120 and the arc shaped guide 132 may be formed integrally. It is needless to say that the present invention covers these modifications.

Figure 12:
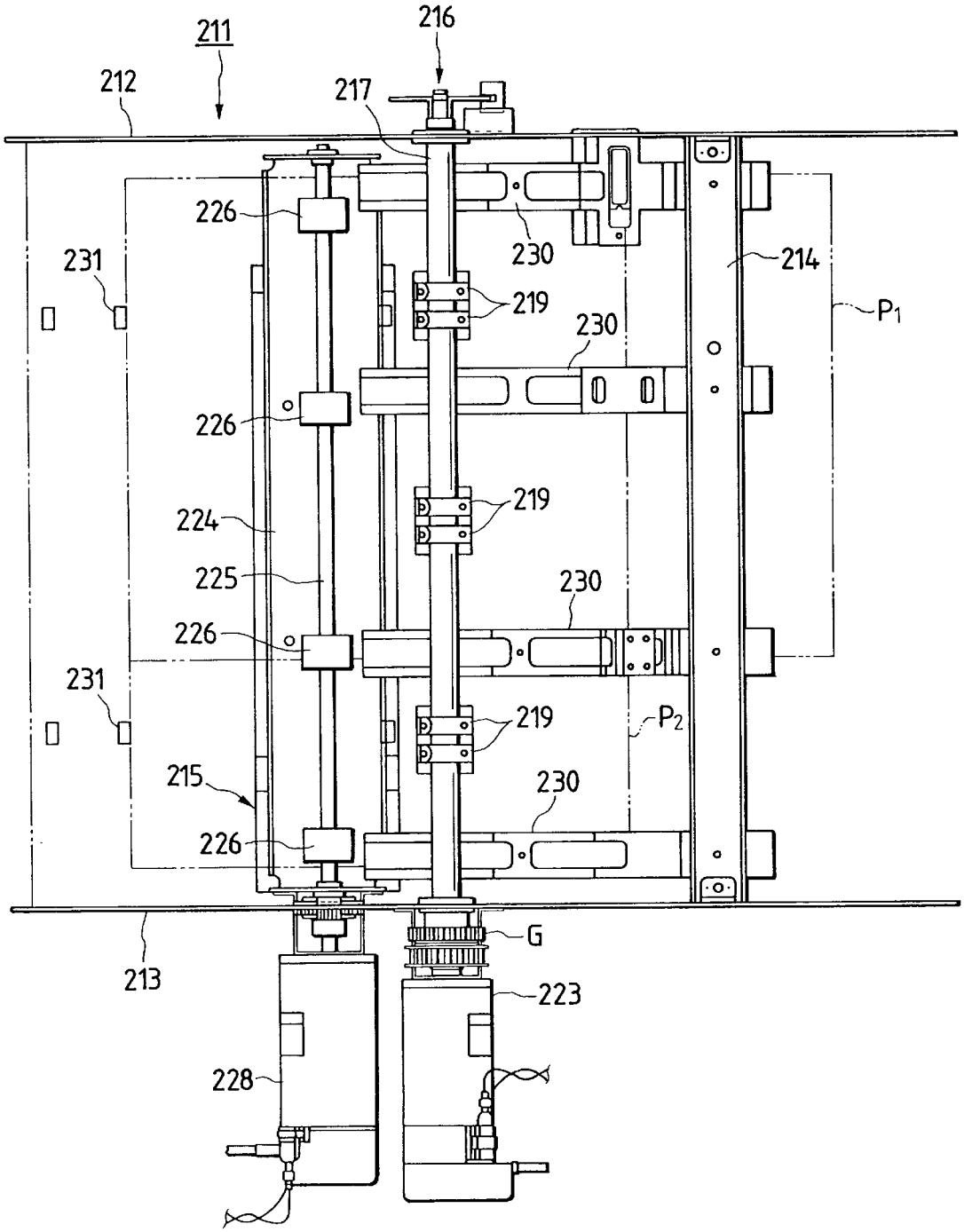
FIG. 12 is a plan view of a rotary punching device according to a still further embodiment of the invention.
Figure 13:
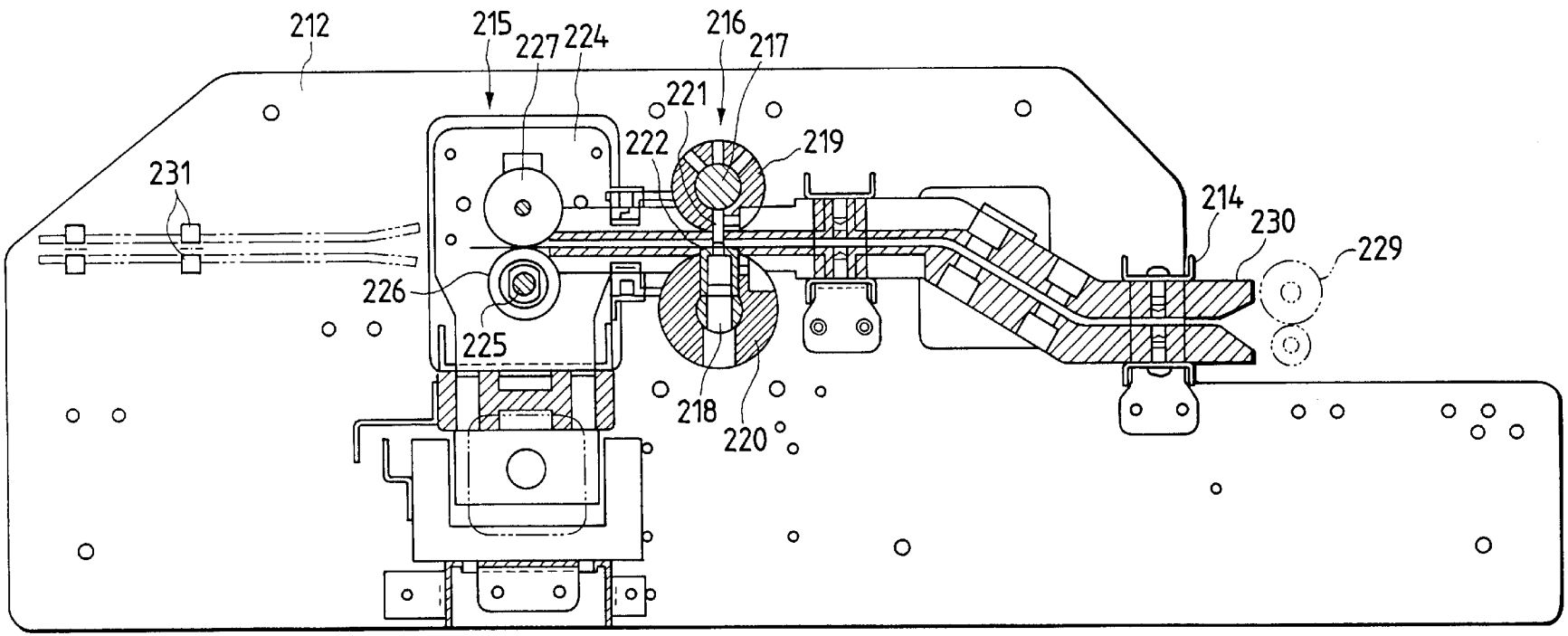
FIG. 13 is a side view of the rotary punching device of FIG. 12.
Figure 14A:
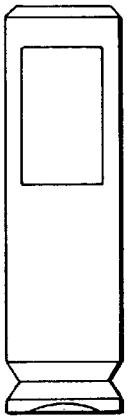
FIGS. 14(*a*), 14(*b*), 14(*c*) and 14(*d*) are a rear elevation, a side elevation, a front elevation, and an end view showing the tip surface of a punch according to the present invention, respectively.
Figure 14B:
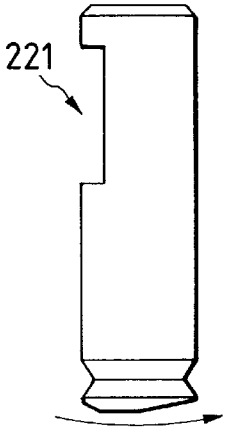
Figure 14C:
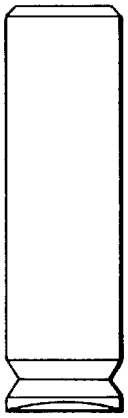
Figure 14D:
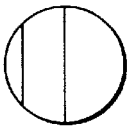

Now, referring to FIGS. 12 to 18(*b*), a detailed explanation will be given of still a further embodiment of the present invention. FIGS. 12 and 13 show a rotary punching device 211 which is incorporated in a copy machine. As seen from FIGS. 12 and 13, a pair of side plates 212 and 213 are coupled by transverse members 214 to constitute a frame. Between the side plates 212 and 213, a sheet feed unit 215 and rotary punching portion 216 (hereinafter referred to as simply "punching portion") are arranged in parallel.

As shown in FIG. 13, at the punching portion 216, an upper punch rotary shaft 217 and a lower die rotary shaft 218 are arranged in parallel. Punch holders 219 are attached to the center of the punch rotary shaft 217 and the right and left thereof, respectively. Die holders 220 are attached to the die rotary shaft 218 at the positions corresponding to the upper punch holders 219. The punch 221 and the die 222 are inserted into the punch attachment hole and die attachment hole made on the outer peripheral surface of the punch holder 219 and die holder 220, respectively and fastened to the rotary shafts 217 and 218 by a fastening screw (not shown).

At one end of the punch rotary shaft 217 and the die rotary shaft 218, flat gear wheels G are fit so as to mesh with each other. The one rotary shaft and servo motor 223 or stepping motor are coupled with each other by a timing belt so that the punch rotary shaft 217 and the die rotary shaft 218 are synchronously rotated.

In the sheet feeding unit 215, sheet feeding rollers 226 are mounted at regular intervals to a rotary shaft 225 hung on the unit frame 224, and as shown in FIG. 13, pinch rollers 227 are arranged at the upper position of the rotary shaft 225 and brought into contact with the sheet feeding rollers 226. Similar to the hole punching portion 216, the rotary shaft 225 is driven by a servo motor 228. Thus, the sheet feeding rollers 226 and the pinch rollers 227 catch the sheet P and feed it from right to left.

The sheet introduced into a sheet guide 230 of the rotary punching device 211 through sheet discharging rollers 229 of a copy machine indicated by dotted line in FIG. 13 passes between the punch holders 219 and die holders 220 and is pulled between the rollers 226 and 227 and fed forward. The control section starts to measure the amount of sheet feeding of the sheet feeding unit 215 when the sheet reaches the positions of photointerrupters 231 arranged forward of the sheet feeding unit 215 and starts to operate the hole punching portion 216 when a predetermined amount of sheet feeding to punch the sheet at a prescribed position in the vicinity of its rear edge.

Figure 15A:
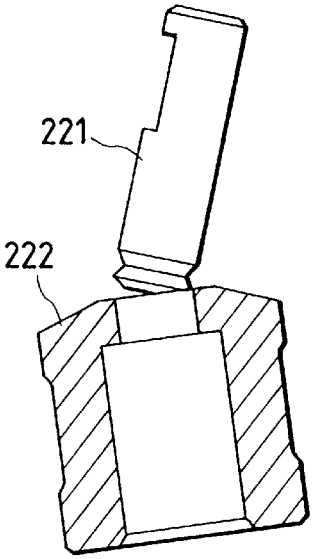
FIGS. 15(*a*) and 15(*b*) show a process of punching a hole.
Figure 15B:
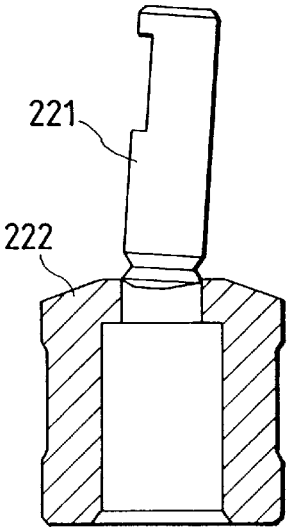

FIGS. 14(*a*) to 14(*c*) show the punch 221. As seen from the side view FIG. 14(*b*), the tip surface has a convex shape with the front and rear in a rotating direction sloped toward the center of rotation. The front (right in the figure) has a more moderate slope than the rear has. The punch 221 starts punching from the point, as shown in FIG. 15(*a*), of starting engagement within an engagement rotation range between the punch 221 and the die 222 and completes it at the point, as shown in FIG. 15(*b*), complete engagement immediately before the center in the engagement rotation range. The punch 221 further rotates and passes the engagement rotation range. Thus, the punch 221 and die 222 are separated from each other.

Figure 16:
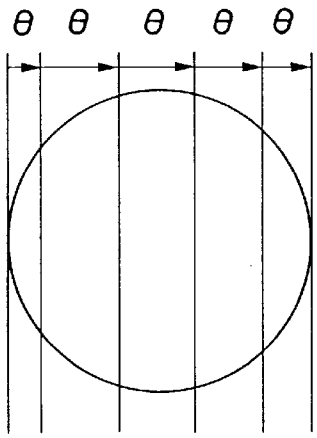
FIG. 16 is a view for explaining the cutting length of a punching hole per a unit of rotating angle in the rotary punching device according to the present invention.
Figure 17:
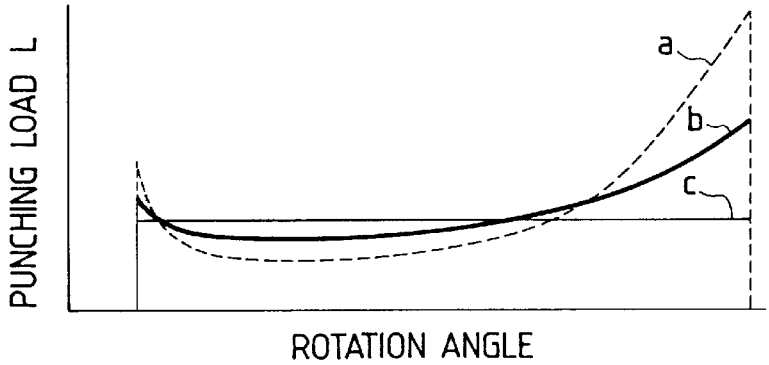
FIG. 17 is a graph showing the relationship between a rotating angle and punching load.
Figure 26:
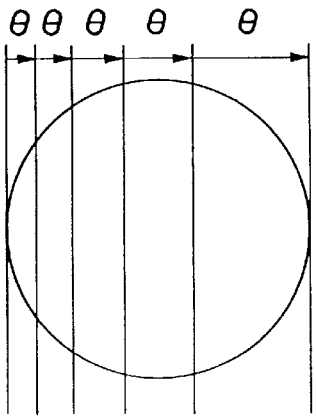
FIG. 26 PRIOR ART
FIG. 26 is a view showing the cutting length of a punching hole per a unit of rotating angle in the conventional rotary punching device.

FIG. 16 shows the punching hole cutting length per a unit of rotating angle θ by the punch 221 and the die 222. Because of the convex shape of the punch 221, the relative angle between the tip surface of the punch 221 immediately after start of engagement and the edge of the die 222 is more parallel than in the conventional rotary punching device. This increases the cutting length per a unit of rotating angle θ in the first half of the cutting stroke from the start of engagement than the conventional rotary punching device, and decreases the cutting length in the second half of the cutting stroke. This makes the cutting length per the unit of rotating angle θ more uniform than the conventional rotary punching device shown in FIG. 26. Thus, as seen from the graph of FIG. 17, the load curve b in this embodiment has a peak of the cutting load lower than the load curve c of the conventional rotary punching device so that the load curve is moderated. This relaxes the torque load of the driving mechanism, and reduces the warping stress applied to the punch rotary shaft 217 and the die rotary shaft 218. Accordingly, the punching performance for a thick sheet of paper can be improved.

Figure 18A:
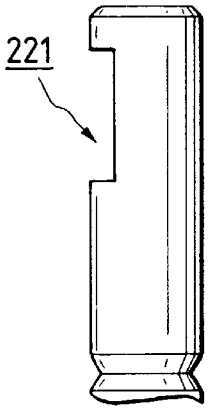
FIGS. 18(*a*) is a side elevation and 18(*b*) is an end view showing the tip surface according to a still further embodiment of the punch.
Figure 18B:
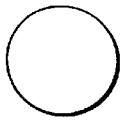

The shape of the tip surface of the punch should not be limited to the shape of FIGS. 14(*a*) to 14(*c*). For example, a continuous curve on the basis of changes in the load for an angle of rotation may be formed in place of the convex shape integral to a flat surface, thus moderating the load curve more effectively. Further, as shown in FIGS. 18(*a*) and 18(*b*), if the front edge (right) of the curved concave surface has an S-shape protruded toward the die when viewed from the side, as shown from the load curve (c) of FIG. 17, the peak at the start of punching can be lowered, thus providing a substantially uniform load curve over the entire punching rotation angle.

The present invention should not be limited to the above embodiment. Various modifications can be made in a technical scope of the present invention. It is needless to say that the present invention covers these modifications.

Figure 19:
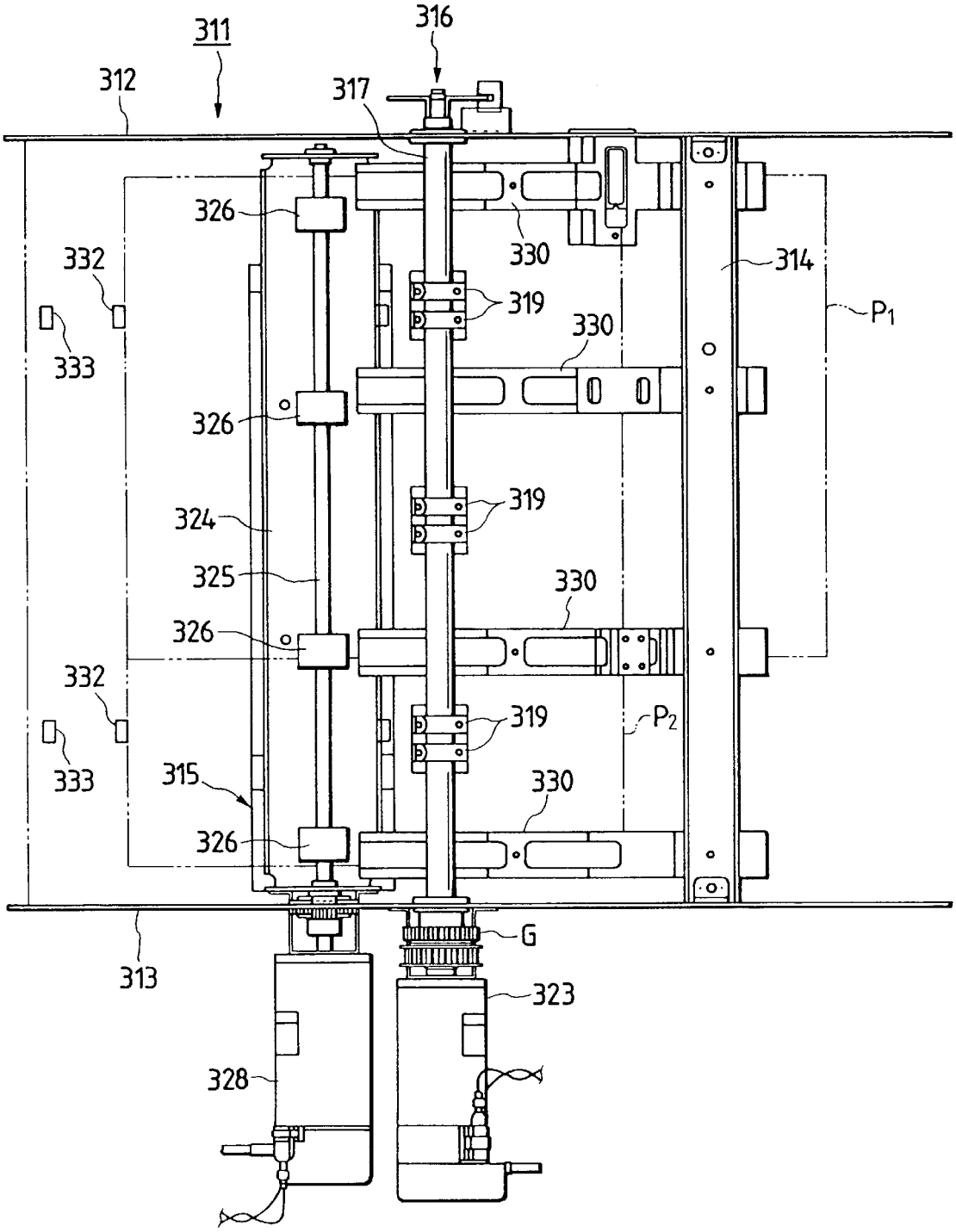
FIG. 19 is a plan view of a rotary punching device according to a still further embodiment of the invention.
Figure 20:
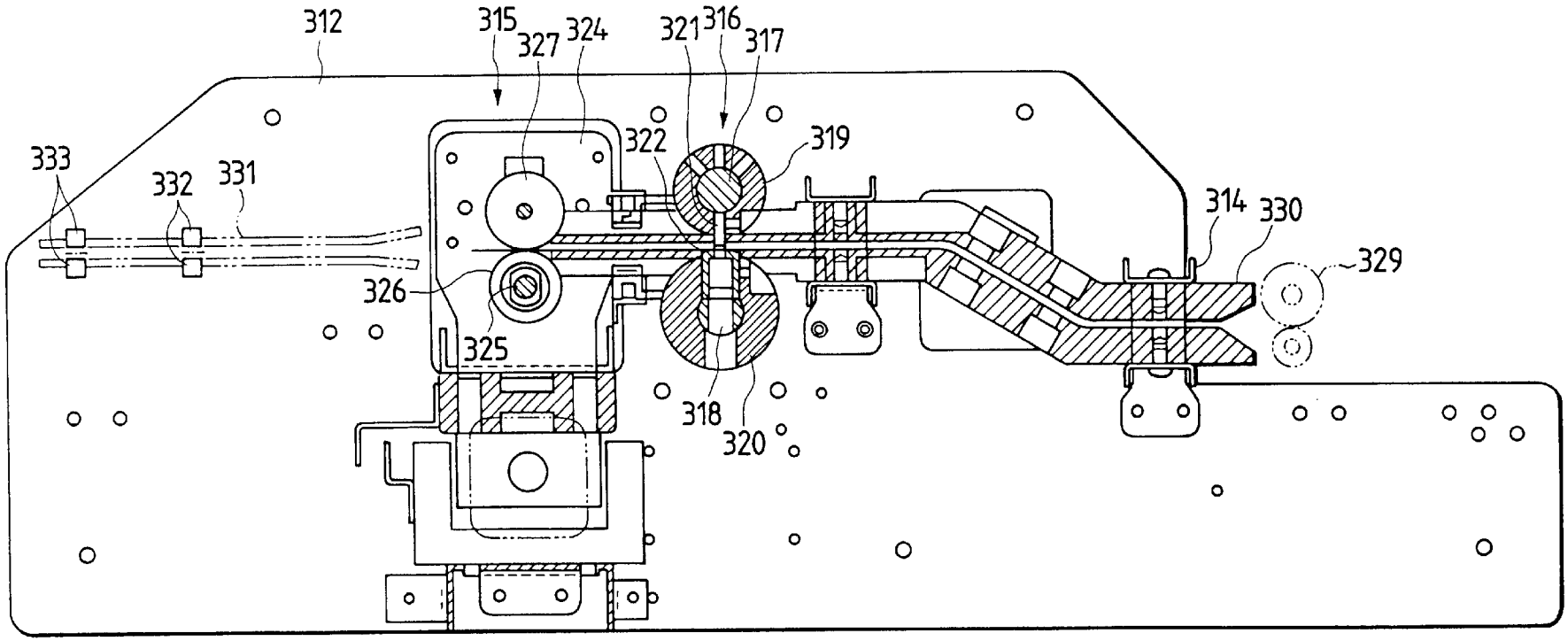
FIG. 20 is a side view of the rotary punching device of FIG. 19.

FIGS. 19 and 20 show a rotary punching device 311 according to still further embodiment of the invention. As seen from FIGS. 19 and 20, a pair of side plates 312 and 313 are coupled by transverse members 314 to constitute a frame. Between the side plates 312 and 313, a sheet feed unit 315 and rotary punching portion 316 (hereinafter referred to as simply "punching portion") are arranged in parallel.

As shown in FIG. 20, at the punching portion 316, an upper punch rotary shaft 317 and a lower die rotary shaft 318 are arranged in parallel. Punch holders 319 are attached to the center of the punch rotary shaft 317 and the right and left thereof, respectively. Die holders 320 are attached to the die rotary shaft 318 at the positions corresponding to the upper punch holders 319. A punch 321 and a die 322 are inserted into the respective punch attachment hole and the respective die attachment hole made on the outer peripheral surface of the punch holder 319 and die holder 320, and fastened to the rotary shafts 317 and 318 by a fastening screw (not shown).

At one end of the punch rotary shaft 317 and the die rotary shaft 318, flat gear wheels G are fit so as to mesh with each other. The one rotary shaft and a punch driving servo motor 323 or stepping motor are coupled with each other by a timing belt so that the punch rotary shaft 317 and the die rotary shaft 318 are synchronously rotated.

In the sheet feeding unit 315, sheet feeding rollers 316 are mounted at regular intervals on a rotary shaft 325 hung on the unit frame 324, and as shown in FIG. 20, pinch rollers 327 are arranged at the upper position of the rotary shaft 325 and brought into contact with the sheet feeding rollers 326. Similar to the hole punching portion 316, the rotary shaft 325 is driven by a servo motor 328. Thus, the sheet feeding rollers 326 and the pinch rollers 327 catch the sheet P and feed it from right to left.

The sheet introduced into a sheet guide 330 of the rotary punching device 311 through sheet discharging rollers 329 of a copier indicated by dotted line in FIG. 20 passes between the punch holders 319 and die holders 320 and is pulled between the rollers 326 and 327 and fed forward.

In front of the sheet feeding unit 315, a front sheet guide 331 is arranged. A total of four photointerrupters 332 and 333 are attached at front and rear, and left and right positions of the front sheet guide 331. The photointerrupters 332 and 333 each comprising a light emitting portion and light receiving portion opposite to each other vertically with a sheet path between to detect the sheet moving in the sheet guide 331.

Figure 21:
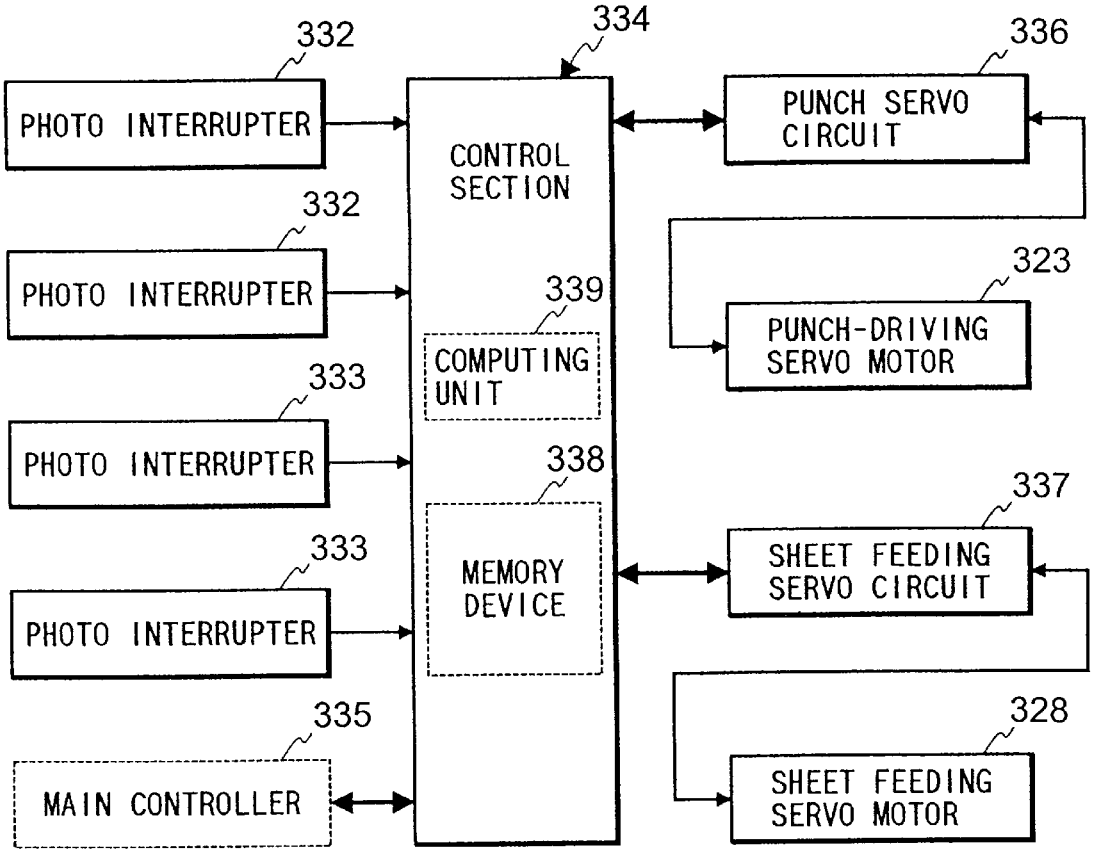
FIG. 21 is a functional block diagram of the rotary punching device.
Figure 22:
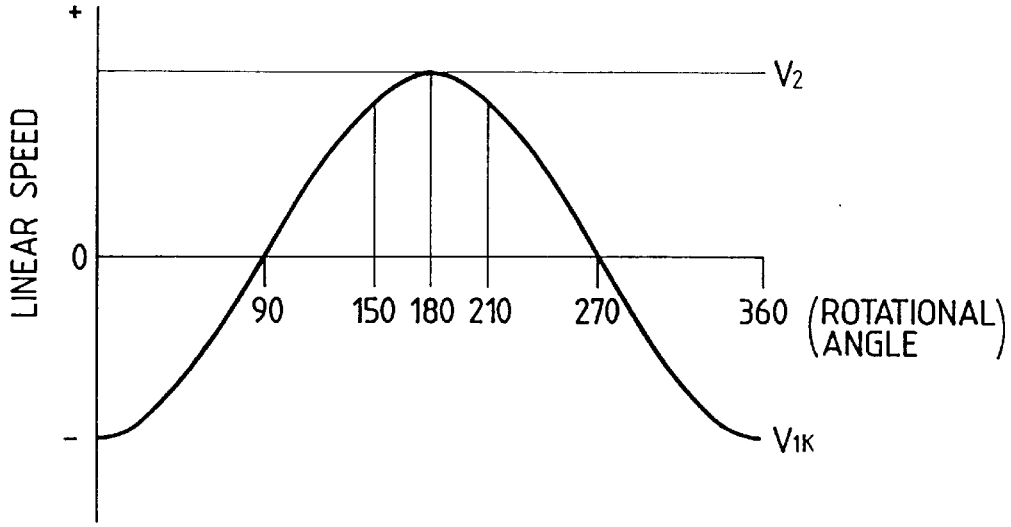
FIG. 22 PRIOR ART
FIG. 22 is a graph showing the sheet feeding speed and the linear speed of a conventional rotary punching device.
Figure 23:
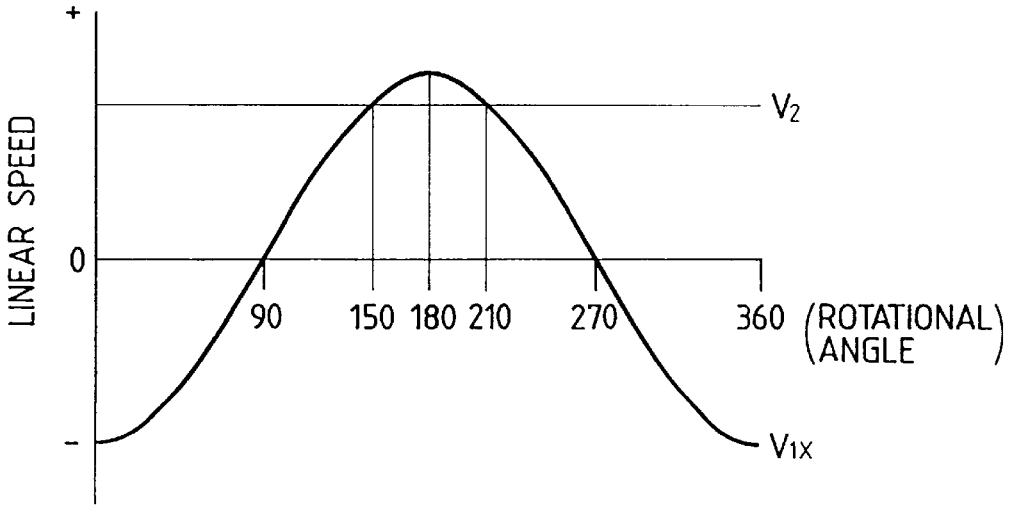
FIG. 23 PRIOR ART
FIG. 23 is a graph showing the sheet feeding speed and the linear speed of a conventional rotary punching device.
Figure 24A:
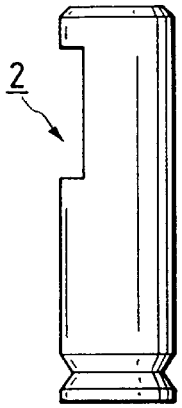
FIG. 24(a) PRIOR ART
FIGS. 24(*a*) is a side elevation and 24(*b*) is an end view of the tip surface of the punch of the conventional rotary punching device.
Figure 24B:
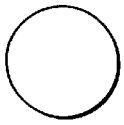
FIG. 24(b) PRIOR ART
Figure 25:
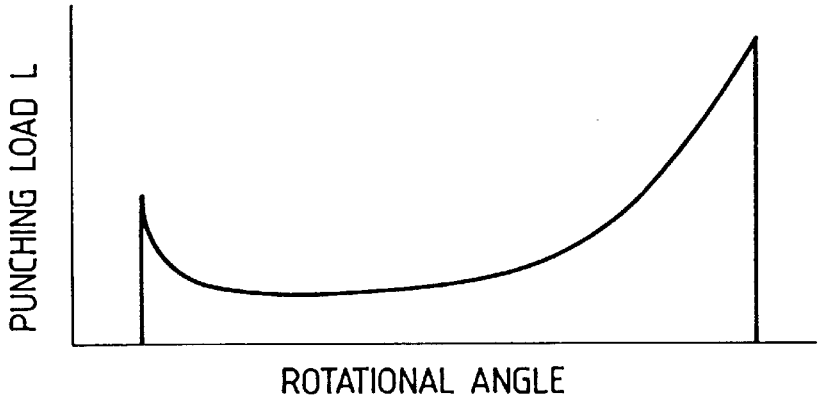
FIG. 25 PRIOR ART
FIG. 25 is a graph showing the rotating angle and punching load in the conventional rotary punching device.

As shown in FIG. 21, the photointerrupters 332 and 333 are connected to a control section 334 of the rotary punching device. The control section 334 is controlled by a command signal from a main controller 335 of a copier into which the rotary punching device 311 is integrated. The control section 334 controls a punch servo circuit 336 and a sheet feeding servo circuit 337 to drive a punch-driving servo motor 323 and a sheet-feeding servo motor 328, respectively.

A memory device 338 of the control section 334 stores a target angular speed of the punch and a target sheet feeding speed equal to the linear speed of the punch determined by the target angular speed and the diameter of the punch.

A computing unit 339 starts to count a clock pulse in response to a sheet detection signal outputted from the upstream photointerrupter 332 close to the sheet feeding unit 315 and latches the count value by the sheet detection signal outputted from the downstream photointerrupter 333. Thus, the computing unit 339 computes the sheet feeding speed based on known distance between the front and rear photointerrupters 332 and 333 and the counted number of pulses.

The acquired sheet feeding speed data are stored in the memory device 338. Then, the control section 334 feeds back the difference between the actual sheet feeding speed and the target sheet feeding speed to the sheet feeding servo circuit 337. Thus, the rotary speed of the sheet feeding servo motor 328 is controlled so that the difference of the sheet feeding speed from the target sheet feeding speed is zero. Therefore, when the punching target position of the sheet P fed in the rotary punching device 311 reaches the punching portion 316, the sheet feeding speed is equal to the target value.

When the number of clock pulses whose counting is started in response to the sheet detection signal of the photointerrupter 332 attains a predetermined number, the punching portion 316 is operated to punch the sheet P at a predetermined position. Poor punching due to inconsistencies between the sheet feeding speed and the linear speed of the punch does not occur.

In another embodiment, control may be made in such a manner that on the basis of the actual sheet feeding speed computed through the photointerrupters 332 and 333, the target angular speed of the punch providing the linear speed of the punch equal to the actual sheet feeding speed is computed, this target angular speed is inputted to the punch servo circuit 36 so that the linear speed of the punch coincides with the actual sheet feeding speed in opposition to the previous embodiment.

As described above, in the rotary punching device according to the present invention, the rotation speed of the punch and die is controlled in an engagement range between them so that the feeding speed of the sheet coincides with the linear speed of the punch and die. Thus, breakage or deformation of the punching hole due to inconsistence of the speeds can be prevented to improve the shaping quality of the punching hole.

As described above, in the rotary punching device according to the present invention, the punched sheet pieces are not discharged from the sheet-piece discharging hole of the die holder during the rotation of the die holder, but are discharged in a single direction when rotation is stopped. Thus, the sheet pieces are not scattered and hence can be removed very easily. Any fear that the scattered sheet pieces will lead to the malfunction of the operation section can be removed. Accordingly, the present invention improve the easiness of handling and reliability of the rotary punching device.

As described above, the rotary punching device according to the present invention makes the cutting length per a unit of rotation angle by the punch and die more uniform than the conventional rotary punching device, thereby lowering the peak of cutting load. The load of the driving mechanism can be relaxed to improve punching capability. The torque load of a motor and the warping stress applied to the punch rotary shaft can be reduced, thus realizing the light weight and miniaturization of the driving mechanism.

As described above, the rotary punching device according to the present invention, which measures the actual speed of sheet feeding and feed-back controls the sheet feeding motor or punch driving motor so as to remove the difference between the sheet feeding speed and linear speed of the punch, does not produce a difference between the sheet feeding speed and linear speed of the punch and the die so that poor punching due to the speed difference can be prevented, thus improving punching accuracy and stability.

What is claimed is:

1. A rotary punching device for punching a hole in a sheet, said device comprising:

a first rotary shaft having an outer peripheral surface;

a punch mounted on the outer peripheral surface of the first rotary shaft;

a second rotary shaft arranged in parallel with the first rotary shaft, the second rotary shaft having an outer peripheral surface;

a die mounted on the outer peripheral surface of the second rotary shaft;

a motor operatively coupled with the first and second rotary shafts to synchronously drive the first and second rotary shafts in opposite directions such that as the first and second rotary shafts are rotated in opposite directions, the punch and die come into hole-punching engagement with each other through a predetermined rotational angle range;

a sheet feeding mechanism for feeding the sheet between the first and second rotary shafts at a constant sheet feeding speed while the punch and the die punch the hole in the sheet;

a die holder attached to the second rotary shaft, having a die attaching hole into which the die is inserted, said second rotary shaft having a transverse hole formed therethrough which is aligned with said die attaching hole;

a sheet piece guide extending generally circumferentially from the die holder in a direction of rotation of the second rotary shaft, the sheet piece guide defining an outer wall of a sheet piece discharging path progressing from an end of the transverse hole opposite the die to an exit opening laterally removed from the end of the transverse hole opposite the die; and control means for controlling the rotation speed of the motor referring to the sheet feeding speed, the control means comprising:

a driving pulse frequency modulation circuit for generating a pulse to the motor, the pulse to vary the speed of the motor satisfying the equation:

$$V_1=-V_2/\cos\theta,$$

where $V_1$ is a circumferential speed of the punch and die, $V_2$ is a sheet feeding speed, and $\theta$ is a rotational angle where the punch and die are engaged, wherein the control means controls the motor such that the linear speed of the punch and die in a sheet feeding direction coincides with the sheet feeding speed through at least a portion of the engagement range between the punch and the die.

2. The rotary punching device according to claim 1, wherein the sheet piece guide is positioned at the die holder opposite to the die.

3. A rotary punching device for punching a hole in a sheet, said device comprising:

a first rotary shaft having an outer peripheral surface;

a punch mounted on the outer peripheral surface of the first rotary shaft, the punch having an elongated body and a cutting end which defines, progressing from a forward-most portion of the cutting end to a rearward-most portion of the cutting end relative to a direction of rotation of the second rotary shaft, a forward planar surface sloped away from the elongated body, an intermediate planar surface having a forward edge coincident with a rearward edge of the forward planar surface, and a rearward planar surface sloped toward the elongated body and having a forward edge coincident with a rear edge of the intermediate planar surface;

a second rotary shaft arranged in parallel with the first rotary shaft, the second rotary shaft having an outer peripheral surface;

a die mounted on the outer peripheral surface of the second rotary shaft;

a motor operatively coupled with the first and second rotary shafts to synchronously drive the first and second rotary shafts in opposite directions such that as the first and second rotary shafts are rotated in opposite directions, the punch and die come into hole-punching engagement with each other through a predetermined rotational angle range;

a sheet feeding mechanism for feeding the sheet between the first and second rotary shafts at a constant sheet feeding speed while the punch and the die punch the hole in the sheet; and control means for controlling the rotation speed of the motor referring to the sheet feeding speed, the control means comprising:

a driving pulse frequency modulation circuit for generating a pulse to the motor, the pulse to vary the speed of the motor satisfying the equation:

$$V_1=-V_2/\cos\theta,$$

where $V_1$ is a circumferential speed of the punch and die, $V_2$ is a sheet feeding speed, and $\theta$ is a rotational angle where the punch and die are engaged, wherein the control means controls the motor such that the linear speed of the punch and die in a sheet feeding direction coincides with the sheet feeding speed through at least a portion of the engagement range between the punch and the die.

4. The rotary punching device according to claim 3 wherein the rearward planar surface has a steeper slope than the forward planar surface.

5. The rotary punching device according to claim 3 wherein said punch is generally cylindrical in shape and has a central axis of rotation and the intermediate planar surface is perpendicular to the central axis of rotation of the punch.

6. A rotary punching device for punching a hole in a sheet, said device comprising:

a first rotary shaft having an outer peripheral surface;

a punch mounted on the outer peripheral surface of the first rotary shaft, the punch having an elongated body and a cutting end which defines, progressing from a forward-most edge of the cutting end to a rearward-most edge of the cutting end relative to a direction of rotation of the second rotary shaft, a first portion sloping from the forward-most edge of the cutting end toward the elongated body followed by a convex portion sloping first away from the elongated body, then inverting in slope, and then sloping toward the elongated body and terminating at the rearward-most edge of the cutting end;

a second rotary shaft arranged in parallel with the first rotary shaft, the second rotary shaft having an outer peripheral surface;

a die mounted on the outer peripheral surface of the second rotary shaft;

a motor operatively coupled with the first and second rotary shafts to synchronously drive the first and second rotary shafts in opposite directions such that as the first and second rotary shafts are rotated in opposite directions, the punch and die come into hole-punching engagement with each other through a predetermined rotational angle range;

a sheet feeding mechanism for feeding the sheet between the first and second rotary shafts at a constant sheet feeding speed while the punch and the die punch the hole in the sheet; and control means for controlling the rotation speed of the motor referring to the sheet feeding speed, the control means comprising:

a driving pulse frequency modulation circuit for generating a pulse to the motor, the pulse to vary the speed of the motor satisfying the equation:

$$V_1 = -V_2/\cos\theta,$$

where $V_1$ is a circumferential speed of the punch and die, $V_2$ is a sheet feeding speed, and $\theta$ is a rotational angle where the punch and die are engaged, wherein the control means controls the motor such that the linear speed of the punch and die in a sheet feeding direction coincides with the sheet feeding speed through at least a portion of the engagement range between the punch and the die.

* * * * *

UNITED STATES PATENT AND TRADEMARK OFFICE

CERTIFICATE OF CORRECTION

PATENT NO. : 5,887,502

DATED : March 30, 1999

INVENTOR(S) : Shigenori YAMAGUCHI et al.

It is certified that error appears in the above-identified patent and that said Letters Patent is hereby corrected as shown below:

ON THE TITLE PAGE, ITEM [30]

INSERT FOREIGN PRIORITY INFORMATION:

Japan 7-247992 09/26/95

Japan 8-166281 06/26/96

Japan 8-167223 06/27/96

Japan 8-167252 06/27/96

Signed and Sealed this

Twenty-third Day of November, 1999

*Attest:*

*Attesting Officer*

Q. TODD DICKINSON

*Acting Commissioner of Patents and Trademarks*